US009630045B1

(12) United States Patent
Martin, Sr.

(10) Patent No.: US 9,630,045 B1
(45) Date of Patent: Apr. 25, 2017

(54) ROTATABLE HANDLE FOR A DUMBBELL BAR

(71) Applicant: Marvin Martin, Sr., Chicago, IL (US)

(72) Inventor: Marvin Martin, Sr., Chicago, IL (US)

( * ) Notice: Subject to any disclaimer, the term of this patent is extended or adjusted under 35 U.S.C. 154(b) by 0 days.

(21) Appl. No.: 14/919,398

(22) Filed: Oct. 21, 2015

(51) Int. Cl.
*A63B 21/072* (2006.01)

(52) U.S. Cl.
CPC ..... *A63B 21/0726* (2013.01); *A63B 21/0728* (2013.01)

(58) Field of Classification Search
CPC ..... A63B 21/072–21/0726; A63B 21/4035; A63B 21/4049
See application file for complete search history.

(56) References Cited

U.S. PATENT DOCUMENTS 4,585,229 A 4/1986 Brasher
5,080,349 A 1/1992 Vittone
5,152,731 A 10/1992 Troutman
D523,493 S 6/2006 Horton
7,862,486 B1 1/2011 Watson
7,892,158 B2 2/2011 Varga
2004/0009858 A1* 1/2004 Tamaribuchi ..... A63B 5/20 482/139
2005/0085352 A1* 4/2005 Baxter ..... A63B 21/0724 482/100
2013/0210589 A1* 8/2013 Thompson ..... A63B 21/0726 482/108
2014/0274598 A1* 9/2014 Anderson ..... A63B 21/0728 482/108
2015/0105224 A1* 4/2015 Odneal ..... A63B 21/0726 482/107

* cited by examiner

*Primary Examiner* — Loan H Thanh
*Assistant Examiner* — Jennifer M Deichl

(57) ABSTRACT

A rotatable handle for a dumbbell bar for allowing hand rotation to reduce the risk of shoulder injury includes a first plate that has an upper face and a lower face, and a second plate that has a top surface and a bottom surface. The bottom surface is pivotally coupled to the upper face, such that the first plate and second plate are freely rotatable. A grip is positioned on the lower face, such that the grip is configured for grasping by the hand of a user. A clamp is coupled to and positioned on the top surface. The clamp is complimentary to a dumbbell bar, such that the clamp is configured to secure the second plate to the dumbbell bar.

11 Claims, 4 Drawing Sheets

ROTATABLE HANDLE FOR A DUMBBELL BAR

BACKGROUND OF THE DISCLOSURE

Field of the Disclosure

The disclosure relates to dumbbell bar attachments and more particularly pertains to a new dumbbell bar attachment for allowing hand rotation to reduce the risk of shoulder injury.

Summary of the Disclosure

An embodiment of the disclosure meets the needs presented above by generally comprising a first plate that has an upper face and a lower face, and a second plate that has a top surface and a bottom surface. The bottom surface is pivotally coupled to the upper face, such that the first plate and second plate are freely rotatable. A grip is positioned on the lower face, such that the grip is configured for grasping by the hand of a user. A clamp is coupled to and positioned on the top surface. The clamp is complimentary to a dumbbell bar, such that the clamp is configured to secure the second plate to the dumbbell bar.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
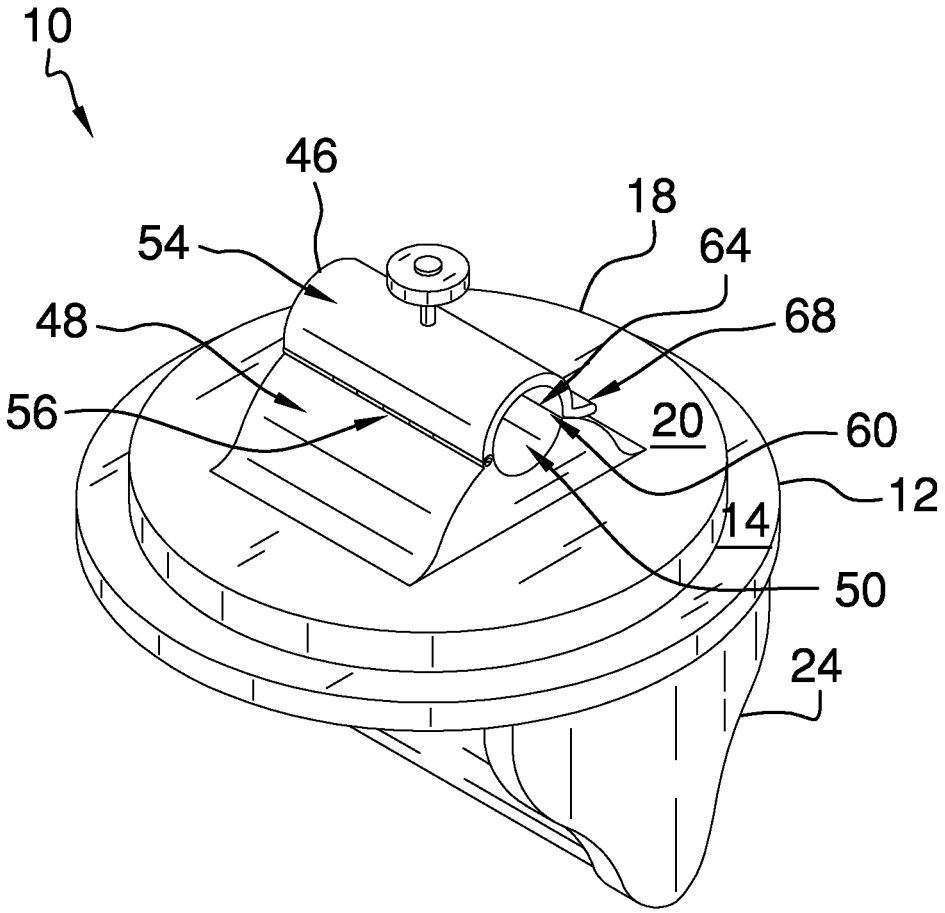
FIG. 1 is an isometric perspective view of a rotatable handle for a dumbbell bar according to an embodiment of the disclosure.
Figure 2:
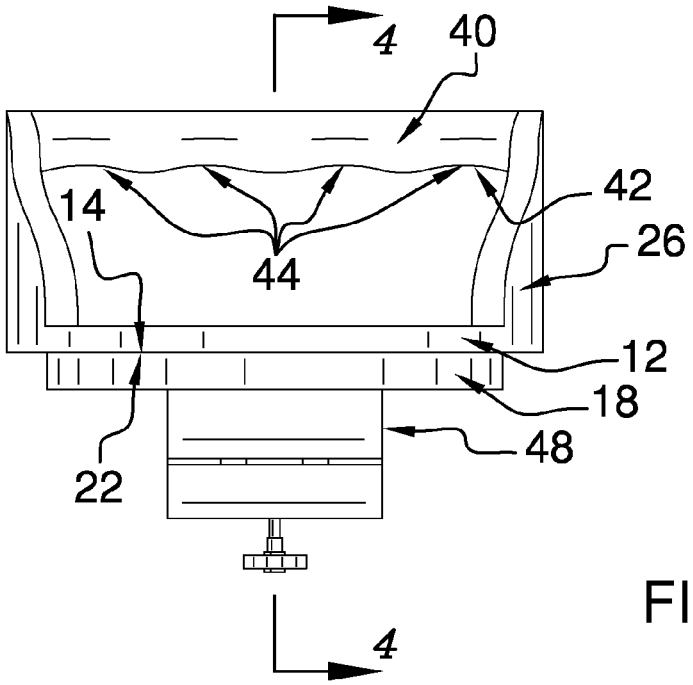
FIG. 2 is a front view of an embodiment of the disclosure.
Figure 3:
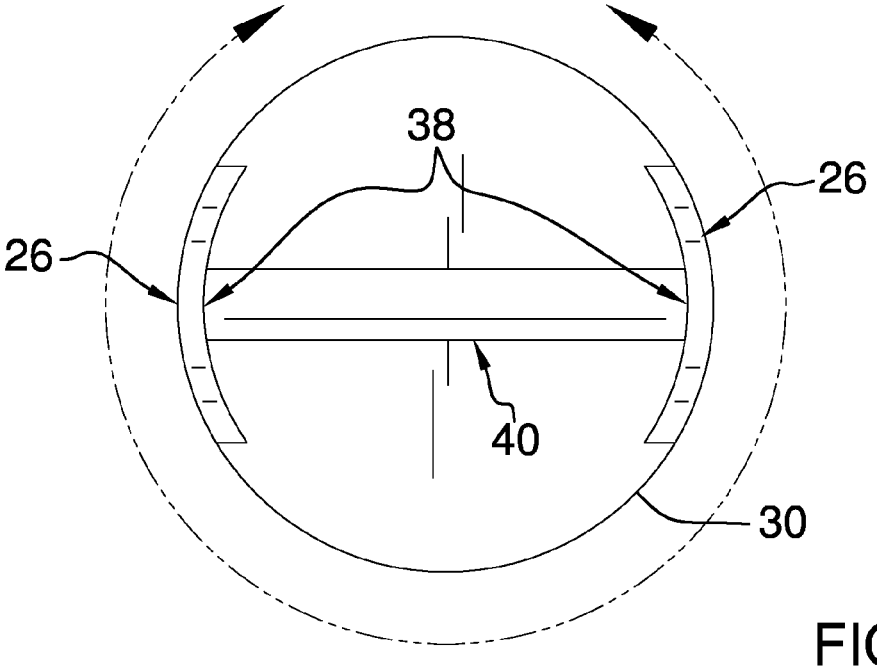
FIG. 3 is a top view of an embodiment of the disclosure.
Figure 4:
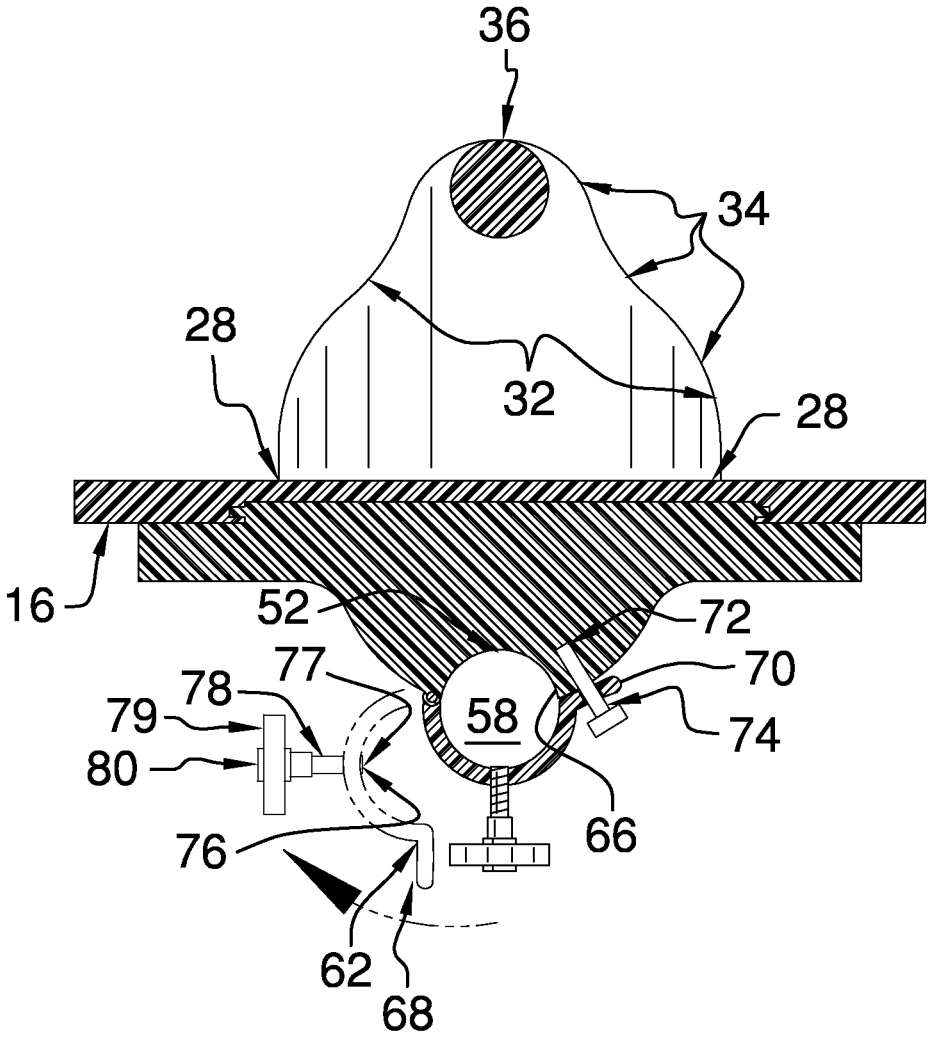
FIG. 4 is a cross-sectional view of an embodiment of the disclosure.
Figure 5:
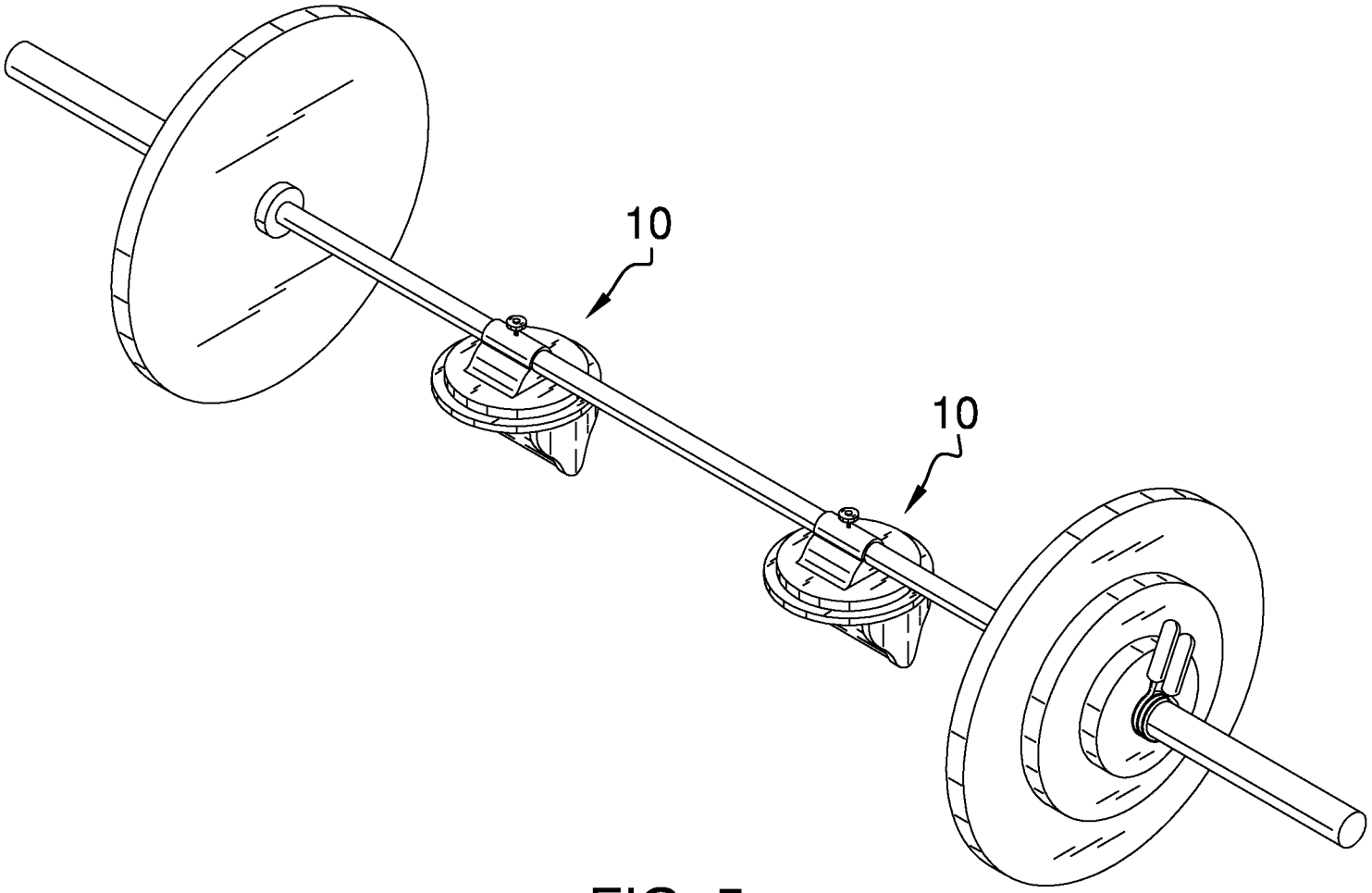
FIG. 5 is an in-use view of an embodiment of the disclosure.

With reference now to the drawings, and in particular to FIGS. 1 through 5 thereof, a new dumbbell bar accessories embodying the principles and concepts of an embodiment of the disclosure and generally designated by the reference numeral 10 will be described.

As best illustrated in FIGS. 1 through 5, the rotatable handle for a dumbbell bar 10 generally comprises a first plate 12 that has an upper face 14 and a lower face 16, and a second plate 18 that has a top surface 20 and a bottom surface 22. The bottom surface 22 is pivotally coupled to the upper face 14, such that the first plate 12 and the second plate 18 are freely rotatable. The second plate 18 may be rotatable by 180 degrees relative to the first plate 12. The first plate 12 and the second plate 18 are round, and the second plate 18 is circumferentially smaller than the first plate 12.

A grip 24 is positioned on the lower face 16, such that the grip 24 is configured for grasping by the hand of a user. The grip 24 comprises a pair of sidebars 26. Each sidebar 26 has a first end 28 coupled to the lower face 16 proximate to a perimeter 30 of the first plate 12, such that the sidebars 26 are disposed at 180 degrees along the perimeter 30. The sidebars 26 have opposing edges 32. Each opposing edge 32 comprises a set of three arcuate curves 34, such that the opposing edges 32 meet and define a second end 36 of the sidebar 26. Each of opposing ends 38 of a crossbar 40 is coupled proximate to a respective second end 36 of the sidebars 26. The crossbar 40 is substantially circular when viewed longitudinally. The crossbar 40 has an inner surface 42 facing the lower face 16 of the first plate 12. The inner surface 42 has a set of four indentations 44, such that the indentations 44 are configured to accommodate the four fingers of a hand inserted into the grip 24.

A clamp 46 is coupled to and positioned on the top surface 20. The clamp 46 is complimentary to a dumbbell bar, such that the clamp 46 is configured to secure the second plate 18 to the dumbbell bar. The clamp 46 comprises a base 48 coupled to and extending from the top surface 20 of the second plate 18. A channel 50 is positioned in a top 52 of the base 48. A clasp 54 is hingedly coupled to a first edge 56 of the channel 50, such that the channel 50 and the clasp 54 form a tube 58 when the clasp 54 is closed. The tube 58 is complimentary to the dumbbell bar. The tube 58 is circular when viewed longitudinally. A first coupler 60 is coupled to a first side 62 of the clasp 54. A second coupler 64 is coupled to the base 48 proximate to a second edge 66 of the channel 50. The second coupler 64 is complimentary to the first coupler 60, such that the second coupler 64 is positioned to engage the first coupler 60 to secure the clasp 54 in a closed position. The first side 62 of the clasp 54 comprises an extension 68. Each of a plurality of holes 70 is positioned through the extension 68. The second coupler 64 comprises a plurality of orifices 72. Each orifice 72 is alignable with a respective one of the plurality of holes 70 in the extension 68. The orifices 72 are threaded. Each of a plurality of screws 74 that is complimentary to the orifices 72 is insertable through a respective one of the holes 70 and threadable into a respective one of the orifices 72, such that the clasp 54 is securable around the dumbbell bar.

A penetration 76 is positioned at a center 77 of the clasp 54. The penetration 76 is threaded. A bolt 78 that is complimentary to the penetration 76 can be tightened to prevent the dumbbell bar from rotating in the tube 58. Each of the screws 74 and the bolt 78 has a tightening ring 79 coupled to a terminus 80 that is distal from the clasp 54.

In use, a pair of the rotatable handles 10 are positionable with a respective channel 50 and a respective clasp 54 configured to attach to a dumbbell bar, such that the user can insert one hand into each grip 24, and such that rotational movement of the inserted hands is allowed during movement of the dumbbell bar due to the rotational coupling of a respective first plate 12 and a respective second plate 18. Enabling the user to rotate their hands while exercising with the dumbbell bar can help prevent injuries, particularly shoulder injuries.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rotatable handle for a dumbbell bar comprising:

a first plate, said first plate having an upper face and a lower face;

a second plate, said second plate having a top surface and a bottom surface, said bottom surface being pivotally coupled to said upper face, such that said first plate and said second plate are freely rotatable;

a grip, said grip being positioned on said lower face, such that said grip is configured for grasping by the hand of a user;

a clamp, said clamp being coupled to and positioned on said top surface, said clamp being complimentary to a dumbbell bar, such that said clamp is configured to secure said second plate to the dumbbell bar, said clamp comprising a base, said base being coupled to and extending from said top surface of said second plate, a channel positioned in a top of said base, a clasp, said clasp being hingedly coupled to a first edge of said channel, such that said channel and said clasp form a tube when said clasp is closed, said tube being complimentary to the dumbbell bar, a first side of said clasp comprising an extension, a first coupler, said first coupler being coupled to said first side of said clasp, a second coupler, said second coupler being coupled to said base proximate to a second edge of said channel, said second coupler being complimentary to said first coupler, and wherein said second coupler is positioned to engage said first coupler to secure said clasp in a closed position;

a plurality of holes, each said hole being positioned through said extension;

said second coupler comprising a plurality of orifices, each said orifice aligning with a respective one of said plurality of holes in said extension, said orifices being threaded;

a plurality of screws, said screws being complimentary to said orifices; and wherein each said screw is insertable through a respective one of said holes and threadable into a respective one of said orifices, wherein said clasp is securable around the dumbbell bar.

2. The device of claim 1, further including said first plate and said second plate being round.

3. The device of claim 2, further including said second plate being circumferentially smaller than said first plate.

4. The device of claim 1, further including said grip comprising:

a pair of sidebars, each said sidebar having a first end and a second end, each said first end being coupled to said lower face proximate to a perimeter of said first plate, such that said sidebars are disposed at 180 degrees along said perimeter; and a crossbar having opposing ends, each said opposing end being coupled proximate to a respective said second end of said sidebars, said crossbar being substantially circular when viewed longitudinally.

5. The device of claim 4, further including said sidebars having opposing edges, each said opposing edge comprising a set of three arcuate curves, such that said opposing edges meet and define said second end.

6. The device of claim 4, further including said crossbar having an inner surface facing said lower face of said first plate, said inner surface having a set of four indentations, such that said indentations are configured to accommodate the four fingers of a hand inserted into said grip.

7. The device of claim 1, further including said tube being circular when viewed longitudinally.

8. The device of claim 1, further comprising:

a penetration, said penetration being positioned at a center of said clasp, said penetration being threaded;

a bolt, said bolt being complimentary to said penetration, such that said penetration is positioned to receive said bolt; and wherein said bolt can be tightened to prevent the dumbbell bar from rotating in said tube.

9. The device of claim 8, further including each said screw and said bolt having a tightening ring coupled to a terminus, said terminus being distal from said clasp.

10. The device of claim 1, further including said second plate being rotatable by 180 degrees relative to said first plate.

11. A rotatable handle for a dumbbell bar comprising:

a first plate, said first plate having an upper face and a lower face;

a second plate, said second plate having a top surface and a bottom surface, said bottom surface being pivotally coupled to said upper face, such that said first plate and said second plate are freely rotatable, said second plate being rotatable by 180 degrees relative to said first plate;

said first plate and said second plate being round, said second plate being circumferentially smaller than said first plate;

a grip, said grip being positioned on said lower face, such that said grip is configured for grasping by the hand of a user;

said grip comprising:

a pair of sidebars, each said sidebar having a first end and a second end, each said first end being coupled to said lower face proximate to a perimeter of said first plate, such that said sidebars are disposed at 180 degrees along said perimeter, said sidebars having opposing edges, each said opposing edge comprising a set of three arcuate curves, such that said opposing edges meet and define said second end, and a crossbar having opposing ends, each said opposing end being coupled proximate to a respective said second end of said sidebars, said crossbar being substantially circular when viewed longitudinally, said crossbar having an inner surface facing said lower face of said first plate, said inner surface having a set of four indentations, such that said indentations are configured to accommodate the four fingers of a hand inserted into said grip;

a clamp, said clamp being coupled to and positioned on said top surface, said clamp being complimentary to a dumbbell bar, such that said clamp is configured to secure said second plate to the dumbbell bar;

said clamp comprising:

a base, said base being coupled to and extending from said top surface of said second plate, a channel positioned in a top of said base, a clasp, said clasp being hingedly coupled to a first edge of said channel, such that said channel and said clasp form a tube when said clasp is closed, said tube being complimentary to the dumbbell bar, said tube being circular when viewed longitudinally, a first coupler, said first coupler being coupled to a first side of said clasp;

a second coupler, said second coupler being coupled to said base proximate to a second edge of said channel, said second coupler being complimentary to said first coupler, such that said second coupler is positioned to engage said first coupler to secure said clasp in a closed position, said first side of said clasp comprising an extension, a plurality of holes, each said hole being positioned through said extension;

said second coupler comprising a plurality of orifices, each said orifice aligning with a respective one of said plurality of holes in said extension, said orifices being threaded, a plurality of screws, said screws being complimentary to said orifices, such that each said screw is insertable through a respective one of said holes and threadable into a respective one of said orifices, wherein said clasp is securable around the dumbbell bar, a penetration, said penetration being positioned at a center of said clasp, said penetration being threaded, a bolt, said bolt being complimentary to said penetration, such that said penetration is positioned to receive said bolt, wherein said bolt can be tightened to prevent the dumbbell bar from rotating in said tube, and each said screw and said bolt having a tightening ring coupled to a terminus, said terminus being distal from said clasp; and wherein a pair of said rotatable handles are positionable with a respective said channel and a respective said clasp configured to attach to a dumbbell bar, such that the user can insert one hand into each said grip, and wherein rotational movement of the inserted hands is allowed during movement of the dumbbell bar due to a respective said first plate and a respective said second plate being rotationally coupled.

* * * * *